US011277701B2

(12) United States Patent
Frank

(10) Patent No.: US 11,277,701 B2
(45) Date of Patent: Mar. 15, 2022

(54) MICROPHONE

(71) Applicant: iSEMcon GmbH, Viernheim (DE)

(72) Inventor: Wolfgang Frank, Viernheim (DE)

(73) Assignee: iSEMcon GmbH, Viernheim (DE)

( * ) Notice: Subject to any disclaimer, the term of this patent is extended or adjusted under 35 U.S.C. 154(b) by 0 days.

(21) Appl. No.: 16/998,029

(22) Filed: Aug. 20, 2020

(65) Prior Publication Data

US 2021/0084421 A1 Mar. 18, 2021

(30) Foreign Application Priority Data

Sep. 12, 2019 (DE) ..... 10 2019 124 533.8

(51) Int. Cl.
*H04R 29/00* (2006.01)
*H04R 3/00* (2006.01)
*H04R 1/08* (2006.01)

(52) U.S. Cl.
CPC ..... *H04R 29/004* (2013.01); *H04R 3/00* (2013.01); *H04R 1/08* (2013.01)

(58) Field of Classification Search
CPC ..... H04R 29/00; H04R 29/004; H04R 3/00; H04R 3/04; H04R 1/08; H04R 1/083; H04R 2203/00; H04R 2410/00
See application file for complete search history.

(56) References Cited

U.S. PATENT DOCUMENTS 4,061,041 A * 12/1977 Fletcher ..... G01H 3/12 73/646
4,491,980 A * 1/1985 Ichikawa ..... H03G 3/32 381/107
5,533,151 A * 7/1996 Leonard ..... G02B 6/1221 359/321
2002/0191800 A1* 12/2002 Armstrong ..... H04R 25/30 381/60
2010/0303250 A1* 12/2010 Goldberg ..... H04R 29/001 381/59

(Continued)

FOREIGN PATENT DOCUMENTS

DE 36 36 720 A1 5/1988
DE 102 10 497 A1 9/2003

(Continued)

OTHER PUBLICATIONS

DIN 15905-5, Event Technology—Sound Engineering—Part 5: Measures to prevent the risk of hearing loss of the audience by high sound exposure of electroacoustic sound systems, Nov. 2007, 10 pages (see specification for relevance).

*Primary Examiner* — Thang V Tran
(74) *Attorney, Agent, or Firm* — Collard & Roe, P.C.

(57) ABSTRACT

A microphone has a microphone capsule, wherein the microphone includes a test arrangement, the test arrangement including an undervoltage detector, a test signal generator unit and an adder. The microphone capsule may be connected to the adder via a first electrical line, a supply voltage line being connected to the undervoltage detector via a second electrical line. In the undervoltage detector the operating DC voltage of the microphone may be comparable with an internal reference DC voltage, the undervoltage detector being electrically connected to the test signal generator unit, and the test signal generator unit may be electrically connected to the adder.

8 Claims, 10 Drawing Sheets

(56) References Cited

U.S. PATENT DOCUMENTS

| | | | | |
|---|---|---|---|---|
| 2011/0033065 | A1* | 2/2011 | Johnson | H03G 3/301 381/107 |
| 2012/0106749 | A1* | 5/2012 | Buck | H04R 3/005 381/66 |

FOREIGN PATENT DOCUMENTS

| | | | | |
|---|---|---|---|---|
| DE | 10 2007 028 194 | A1 | | 2/2008 |
| DE | 10 2012 220 137 | A1 | | 5/2014 |
| EP | 0 589 974 | B1 | | 7/1998 |
| GB | 2 386 498 | A | | 9/2003 |
| KR | 20030062956 | A | * | 7/2003 |

* cited by examiner

MICROPHONE

CROSS REFERENCE TO RELATED APPLICATIONS

Applicant claims priority under 35 U.S.C. § 119 of German Application No. 10 2019 124 533.8 filed Sep. 12, 2019, the disclosure of which is incorporated by reference.

BACKGROUND OF THE INVENTION

1. Field of the Invention

The invention relates to a microphone.

2. Description of the Related Art

Especially for large events with several performance venues, it is necessary to provide large-scale monitoring of the sound levels across the entire venue.

For example, a microphone with an integrated sound level meter can be provided to measure these sound levels. This microphone can, for example, be a handheld device with an integrated display. However, such monitoring is very costly and personnel-intensive, because a handheld device is required for each measuring point and is therefore less suitable for large events.

In addition, sound level meters with detachable microphone and dedicated connection cable as well as measurement microphones with separate cable and dedicated measurement interface with a computer interface can be used for sound level measurements. However, with these two variants there is uncertainty with regard to the cable connections, since these can very quickly become defective. Possible manipulations cannot be avoided.

From DE 36 36 720 A1 a test device is known with which a method for functional testing of a microphone can be carried out. In this method, at least one loudspeaker is arranged at a fixed, preferably small, distance from the microphone and a test signal is applied to it, the signal frequency of which lies in the operating frequency range of the microphone. The phase difference between the microphone output signal and the test signal is measured, the measured phase difference being compared with a tolerance-prone target value and a good signal or a bad signal being output if the measured phase difference lies within or outside the tolerance range.

DE 10 2012 220 137 A1 describes a circuit arrangement for testing a dynamic microphone. The circuit arrangement comprises at least one test signal generation stage, through which the microphone can be subjected to an AC test voltage.

Finally, EP 0 589 974 A1 discloses a method for testing one or more capacitive converters by a central control unit, each converter being connected to an input of a preamplifier with a relatively high input resistance and a test line extending from the central control unit to the converters. The test of each converter is carried out with the help of a test signal which is transmitted via the test line. A capacitor with a small capacitance is provided in the test line for the connection between the converter and the input of the preamplifier, and by selecting the capacitance inserted in the test line with a very high equivalent parallel resistance or leakage resistance, which is large compared to the impedance of the capacitance. Frequency characteristic values, for example in the case of one or more discrete frequencies, are measured via the test line and the frequency characteristic values obtained are compared with previously determined characteristic values in order to identify errors which may occur in the converter. The test lead is connected to a changeover switch in the control unit, which is either connected to a housing or to an AC test voltage.

SUMMARY OF THE INVENTION

The object of the present invention is to provide a microphone with which rapid, efficient and precise testing and diagnosis of the operating states of the microphone and of all downstream signal connection lines and signal processing devices is possible.

This object is achieved according to the features of the invention.

The invention thus relates to a microphone with a test arrangement for testing the microphone and external system components which are connected to the microphone. The microphone is preferably a measuring microphone for sound level monitoring. External system components are to be understood as all signal connection lines and signal processing devices connected downstream of the microphone.

The microphone has a microphone capsule and the test arrangement, the test arrangement containing an undervoltage detector, a test signal generator unit and a adder. The microphone capsule is connected to the adder via a first electrical line. A supply voltage line of the microphone capsule is connected to the undervoltage detector via a second electrical line, the direct voltage of the microphone being compared with an internal reference direct voltage in the undervoltage detector. The undervoltage detector is in turn electrically, preferably via an electrical line, connected to the test signal generator unit, the test signal generator unit being connected downstream of the undervoltage detector. The undervoltage detector can switch over the frequency of the test signal generator unit. Finally, the test signal generator unit is connected to the adder, preferably via an electrical line.

This test arrangement ensures quick, efficient and precise testing and diagnosis of the operating states of the microphone and all system components. For this purpose, the test arrangement generates a permanent, calibrated test signal that is fed in in addition to the microphone signal. The microphone signal generally covers the audible frequency spectrum (10 Hz to 20 kHz). The permanent calibrated test signal is in the range above twice the maximum signal frequency, so that the resulting intermodulation products are above 20 kHz and the actual microphone signal (microphone spectrum) is transmitted without feedback.

The test signal is preferably in the form of a sinusoidal signal with a calibrated amplitude and allows the suitability of the system components used to be assessed and signal-influencing changes to be recognized and detected by, for example, cables, attenuators, signal amplifiers, digitization with and without data compression, for example when using radio links to prevent such manipulation, since such manipulation is accompanied by a change in the amplitude of the test signal. To do this, however, it is necessary to first determine the transmission behaviour of the system at a lower frequency in the listening area compared to the permanent test signal frequency, because the frequency response of the system components usually drops towards higher frequencies.

The test arrangement also ensures that the correct power supply to the microphone is ensured. This is particularly important for event security, because sound level monitoring requires the correct measurement and transmission of high signal alternating voltages, sometimes up to over 20 Vpp, depending on the microphone sensitivity (see also DIN 15905-5, for example). For this purpose, the test arrangement has an undervoltage detector which, by switching over the generator frequency, causes a frequency jump of, for example, 10 kHz in the amplitude-calibrated test signal in a microphone. An undervoltage of a microphone can be clearly detected by the frequency jump of the permanent test signal. This undervoltage detector ensures that the microphone is provided with a sufficiently high supply voltage. A supply voltage that is too low prevents sufficiently high signal ac voltages corresponding to the sound level from being generated. In this case, the microphone can no longer reproduce the high sound pressure levels.

It is also advantageous that testing and diagnosis of the microphone and all downstream system components is possible solely with the test arrangement located in the microphone. External test devices are not required. Only software for diagnosis needs to be provided. It is furthermore advantageous that a suitable, calibrated test signal is made available to a user, on the basis of which it is possible to assess the suitability of the microphone and the system components used for transmitting high signal alternating voltages with correspondingly high sound levels.

With this test arrangement, it is possible to distinguish between several microphones at the event location on the basis of the frequency-coded test signal (microphone 1: test signal frequency of 41 kHz; microphone 2: test signal frequency of 42 kHz; microphone 3: test signal frequency of 43 kHz, etc.) of the individual microphones. Hence, confusion of the microphones in the sound level measurement in audio networks is avoided.

In a preferred embodiment, the test signal generator unit of the microphone has a signal generator. An electronic switch can be used to switch between the reference test signal and the permanent test signal. This variant has a very compact design because the test signal generator unit consists only of the signal generator. The circuitry is also very low. However, reference AC test voltage and permanent AC test voltage must be evaluated one after the other.

In a further embodiment, the test signal generator unit has a test signal generator and a reference test signal generator, the reference test signal generator being switchable via a switch. The advantage here is that the reference AC test voltage and the permanent AC test voltage can be evaluated simultaneously.

In another embodiment, the test signal generator unit additionally has a noise generator, the noise generator being switchable via an electronic switch. The amplitude frequency response of external system components can be measured with this noise generator.

In a further preferred embodiment, the microphone has a first inverting output driver and a second non-inverting output driver, as a result of which the microphone has a symmetrical microphone output.

In another preferred embodiment, the evaluation and diagnosis of the function of the microphone and the downstream system components is carried out very quickly and easily by means of software from a computer.

Finally, the invention relates to a method for sound level monitoring. The process comprises the following successive steps:

1. Exposing the microphone to an external acoustic sound pressure level at the level of the typical microphone sensitivity at 94 dB at a defined frequency (for example 1 kHz) or applying the microphone to a sound pressure level of 114 dB at a defined frequency (for example 1 kHz) and subsequent measurement the amplitude of the microphone output signal.
2. Switch off or remove the acoustic test sound level and switch on the reference test signal (=actual reference test alternating voltage) at the maximum sound pressure level to be recorded (=upper limit of the alternating test voltage).
3. Measurement of the amplitude of the reference test signal and check for plausibility of the measured amplitudes.
4. Hook-up of the permanent test signal or switching the reference test signal to a permanent test signal.
5. Comparison of the amplitude of the reference test signal with the amplitude of the permanent test signal, whereby a level difference is obtained, which corresponds to an amplitude correction factor.
6. Monitoring of the permanent test signal in relation to the amplitude and frequency of each microphone.

It is advantageous in this method that different microphones can be distinguished on the basis of a production-specific, different test signal frequency (=frequency coding) of the permanent test signal within the test signal generator unit, so that several microphones with different test signal frequencies can work within a network of microphones in an audio network and are clearly identifiable.

By combining the test signal frequency and test signal amplitude, the operating states of each microphone, as well as the operating states of the signal chain, can be recorded and any manipulations can be analysed and verified.

It is also explicitly proposed to combine several features of the individual described embodiments with one another.

BRIEF DESCRIPTION OF THE DRAWINGS

Other objects and features of the invention will become apparent from the following detailed description considered in connection with the accompanying drawings. It is to be understood, however, that the drawings are designed as an illustration only and not as a definition of the limits of the invention.

In the drawings.

DETAILED DESCRIPTION OF PREFERRED EMBODIMENTS

Figure 1:
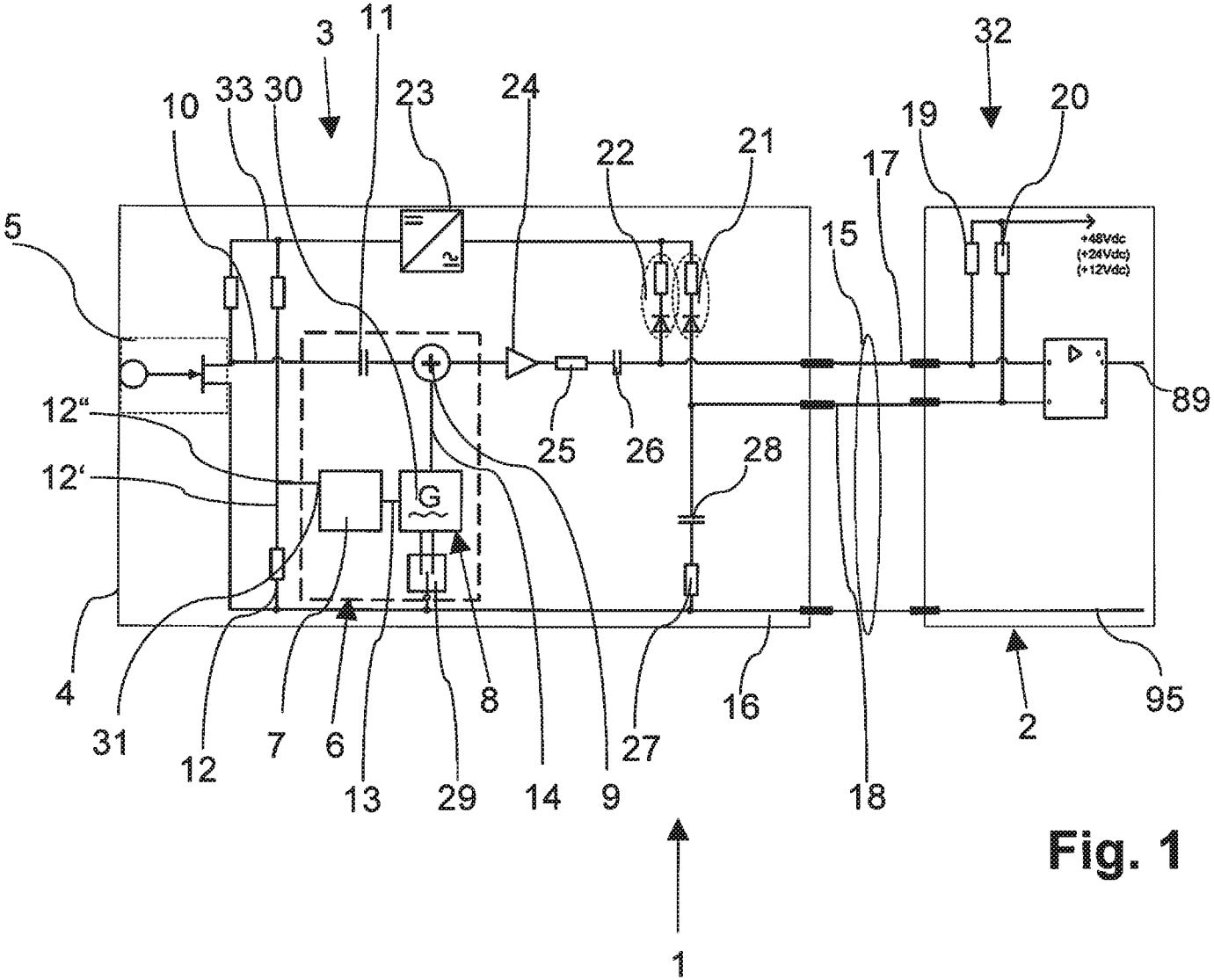
FIG. 1 shows a schematic view of an arrangement of power supply and a first variant of a microphone.

In FIG. 1 there is shown a schematic view of an arrangement 1 of power supply 2 and a first variant of a microphone 3. The power supply unit 2 is part of an arrangement 32 of external system components, wherein further external system components are not shown.

The microphone 3 has a housing 4 in which a microphone capsule 5 and a test arrangement 6 are accommodated. The test arrangement 6 contains an undervoltage detector 7, a test signal generator unit 8 and a adder 9. The microphone capsule 5 is connected to the adder 9 via a first electrical line 10, a coupling capacitor 11 being provided between the adder 9 and the microphone capsule 5.

The supply voltage line 33 is connected to the undervoltage detector 7 via a second electrical line 12, 12', 12", an operating voltage of the microphone 3 being compared with a reference voltage in the undervoltage detector 7. The microphone 3 is supplied with energy via the supply voltage line 33. The test signal generator unit 8 is connected to the undervoltage detector 7, the test signal generator unit 8 being electrically connected to the adder 9. The undervoltage detector 7 is preferably connected to the test signal generator unit 8 and the test signal generator unit 8 to the adder 9 via electrical lines 13, 14.

The microphone 3 is powered by phantom power from the external power supply 2. For this purpose, a connecting line system 15 is provided, consisting of a ground line 16, a first signal line 17 and a second signal line 18. The phantom power supply itself is generated by the power supply unit 2 and supplied to the signal lines 17 and 18 via feed resistors 19 and 20. Within the microphone 3, the phantom voltage is coupled out via a diode resistor network 21 and 22 and fed to a voltage stabilization device 23. This voltage stabilization device 23 supplies the microphone capsule 5 and thus the entire microphone 3 with energy.

The test signal generator unit 8 consists of only one signal generator 30. The reference test signal can be switched to a permanent test signal by means of an electronic switch 29.

The signal generator 30 provides a calibrated reference signal UR at a representative level of the maximum sound level to be detected and as a function of the microphone sensitivity UM, for example UM=94 dB, where: UR=UM+xdB. The reference test signal, preferably with a frequency in the range of the standardized acoustic calibration signal for sound level calibration (for example 94 dB at 1 kHz), is fed to the adder 9.

The reference test signal is available together with an output signal US (microphone output signal US) coming from the microphone capsule 5 at the output of the adder 9.

The undervoltage detector 7 is connected upstream of the signal generator 30. This undervoltage detector 7 compares the supply voltage of the microphone 3 with the reference voltage at an input 31.

If the operating voltage falls below the reference voltage, this is detected by the undervoltage detector 7 as an undervoltage, and the undervoltage detector 7 switches the signal generator 30 to a significantly lower permanent test signal frequency.

A microphone undervoltage can thus be reliably detected and transmitted to the evaluation software of a computer (not shown). Since the test signal generator unit 8 comprises only one switchable signal generator 30, the test signal generator unit 8 has a compact design and the circuitry effort is very low. However, the reference test signal and the permanent test signal must be evaluated one after the other.

The output signal US coming from the microphone capsule 5 is applied to the input of the adder 9 in terms of AC voltage via the coupling capacitor 11 and is thus available for further signal processing by a subsequent output driver 24.

The output of the output driver 24 drives the first signal line 17 of the microphone 4 via an impedance network 25, 26. The second impedance network 27, 28 short-circuits the second signal line 18 in terms of AC voltage to the ground line 16. The second signal line 18 is therefore only used for energy supply (economy circuit). In this embodiment, the internal signal processing is therefore asymmetrical.

The test arrangement guarantees that the correct power supply to the microphone is ensured.

This is particularly important for event security, because sound level monitoring requires the correct measurement and transmission of high signal alternating voltages, sometimes up to 20 Vpp, depending on the microphone sensitivity (see DIN 15905-5, for example).

For this purpose, the test arrangement has the undervoltage detector, which, by switching the generator frequency, causes a frequency jump of, for example, 10 kHz in the amplitude-calibrated test signal in a microphone. An undervoltage of a microphone can be clearly detected by the frequency jump of the permanent test signal.

Figure 2:
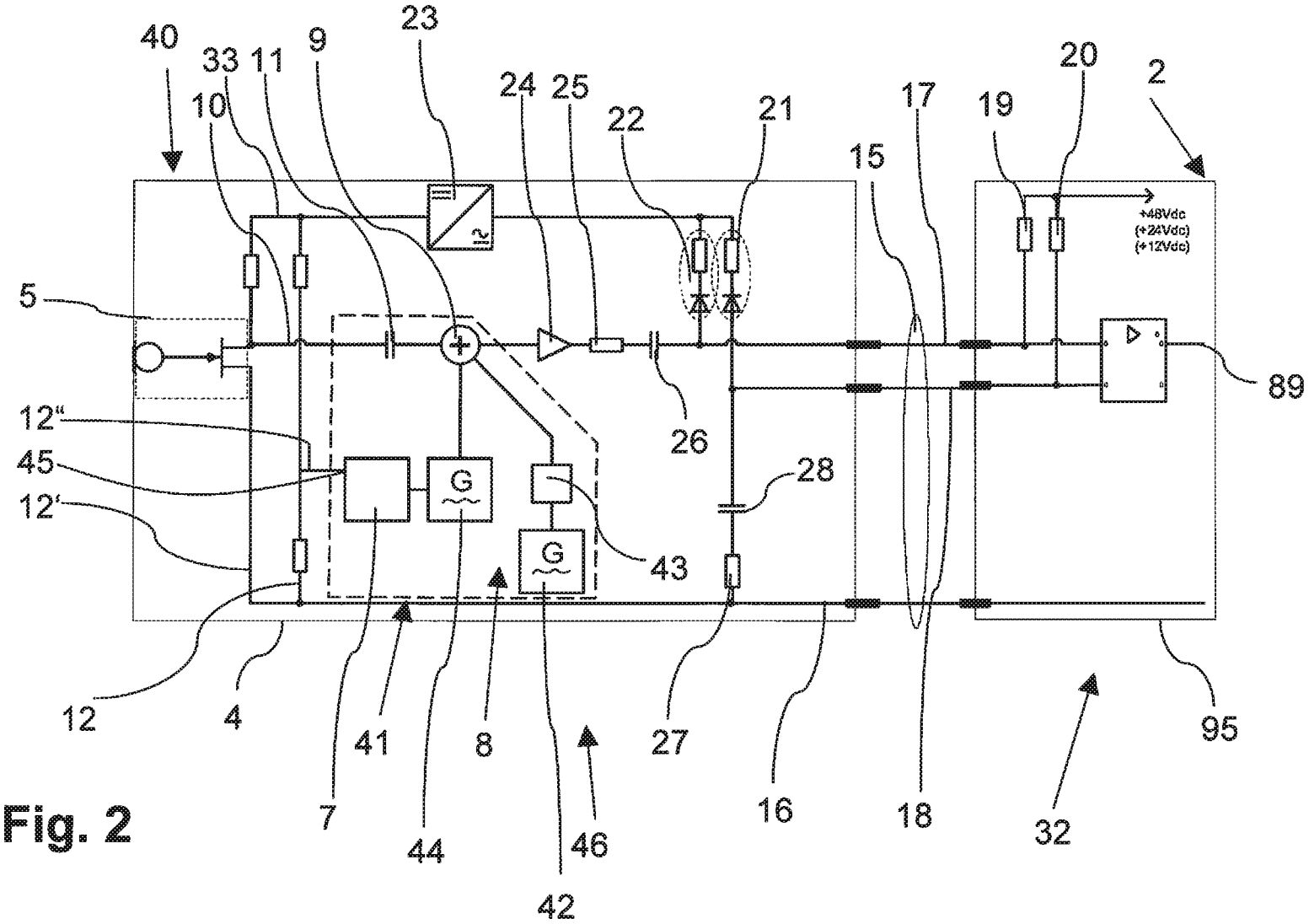
FIG. 2 shows an arrangement of power supply and a second variant of a microphone.

FIG. 2 depicts an arrangement 46 from the power supply 2 pursuant to FIG. 1 and a second variant of a microphone 40. The microphone 40 differs from the microphone according to FIG. 1 only in that the microphone 40 has a test arrangement 41, being constructed differently.

Most of the reference numbers have therefore been retained.

The test arrangement 41 in turn comprises the undervoltage detector 7, the test signal generator unit 8 and the coupling capacitor 11 and the adder 9 connected downstream of the coupling capacitor 11. However, the test signal generator unit 8 does not consist of only one signal generator. Rather, a sine reference test signal generator 42 is provided, which can be switched on via a switch 43. The sine reference test signal generator 42 provides a calibrated reference test signal UR at a representative level of the maximum sound level to be recorded and as a function of the microphone sensitivity UM, where UR=UM+xdB (with UM being 94 dB, for example) applies. The calibrated reference test signal is also available in this variant together with the microphone signal US at the output of the adder 9.

The reference test signal can be switched on and off manually or remotely via the electronic switch 43. In addition to the reference test signal generator 42, which can be switched on and off, the microphone 40 contains a permanent test signal generator 44, the output voltage UP of which, unlike the reference test signal UR, has no effect on the microphone signal US.

The test signal generator 44 generates a test signal that is variable in frequency and has an amplitude that corresponds to the reference test signal UR. The test signal frequency fN is fixed according to the microphone coding. The test signal of a defined frequency fN and a defined amplitude UP=UR being generated is fed to the adder 9 and is available to the output driver 24 at the microphone output 17, together with the microphone AC voltage US. The undervoltage detector 7 is connected upstream of the test signal generator 44. This undervoltage detector 7 compares the operating voltage of the microphone 40 with its internal reference voltage at an input 45. If the operating voltage falls below the reference voltage, this is detected as an undervoltage, and the undervoltage detector 7 switches the test signal generator 44 to a significantly lower frequency. A microphone undervoltage can thus be reliably detected and transmitted to the evaluation software of a computer (not shown).

Figure 3:
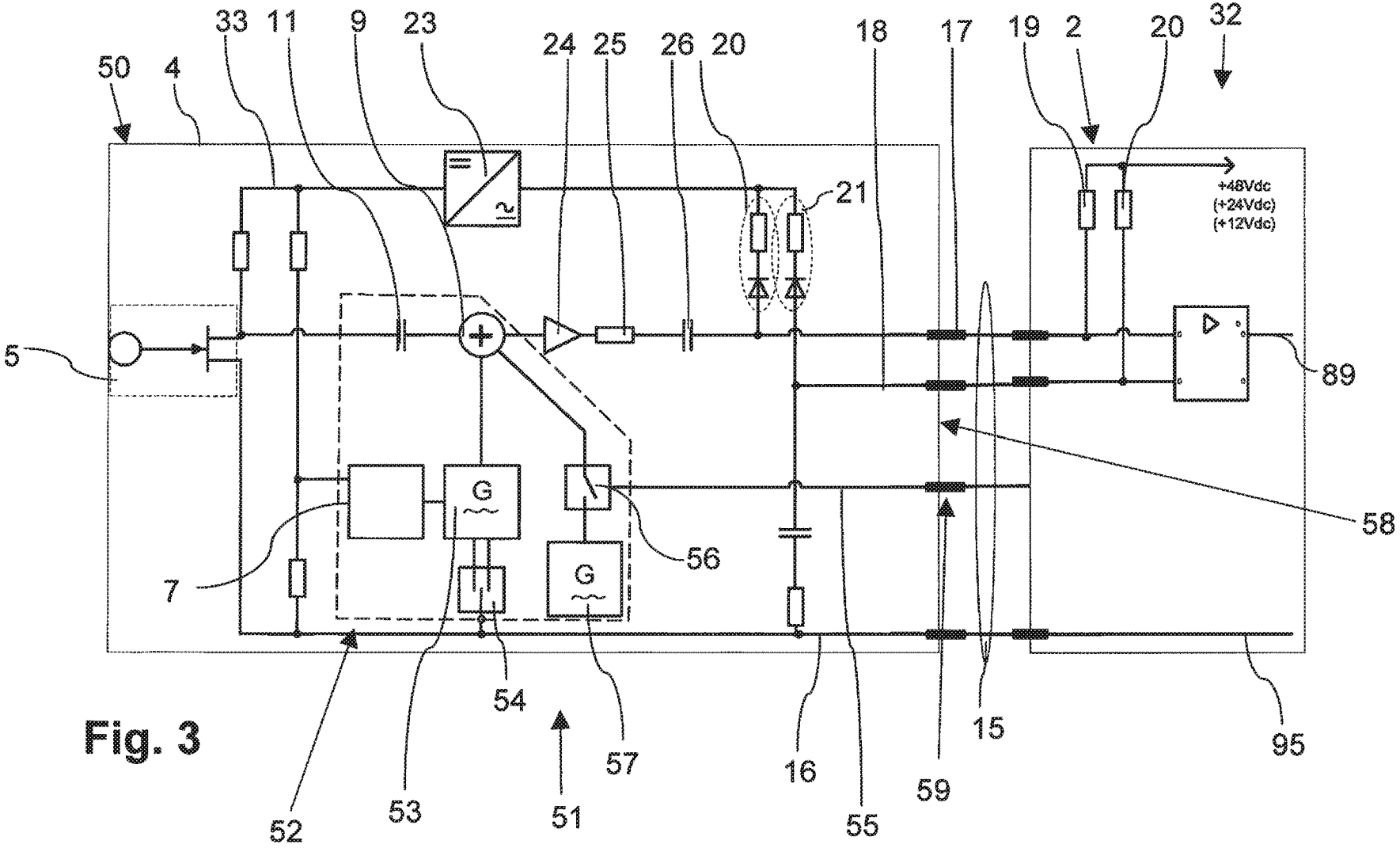
FIG. 3 shows an arrangement of power supply and a third variant of a microphone.

FIG. 3 depicts a third variant of a microphone 50, which in turn is connected to the power supply 2. Microphone 50 and power supply 2 form an arrangement 51. The microphone 50 differs from those shown in FIG. 1 and FIG. 2 only in the structure of the test arrangement, which is why the reference numbers have been essentially retained.

For the sake of clarity, however, not all elements have been provided with reference numbers. The microphone 50 comprises a test arrangement 52 which has the undervoltage detector 7, a test signal generator unit 53, the coupling capacitor 11 and the downstream adder 9.

The test signal generator unit 52 comprises a signal generator 53 and an electronic switch 54 with which the test signal can be switched between the reference test signal and the permanent test signal.

The signal generator 53 is in contact with the adder 9. In this respect, this arrangement 51 does not differ from that shown in FIG. 1. In addition, the test signal generator unit 52 includes an additional noise generator 57, which can be connected via a control line 55 and an electronic switch 56, for measuring and assessing the amplitude frequency response of the system components (not further shown), starting with the microphone output 58 up to software evaluation.

A remote control input 59 can also be seen, via which the noise generator signal of the noise generator 57 can be switched on or off.

Figure 4:
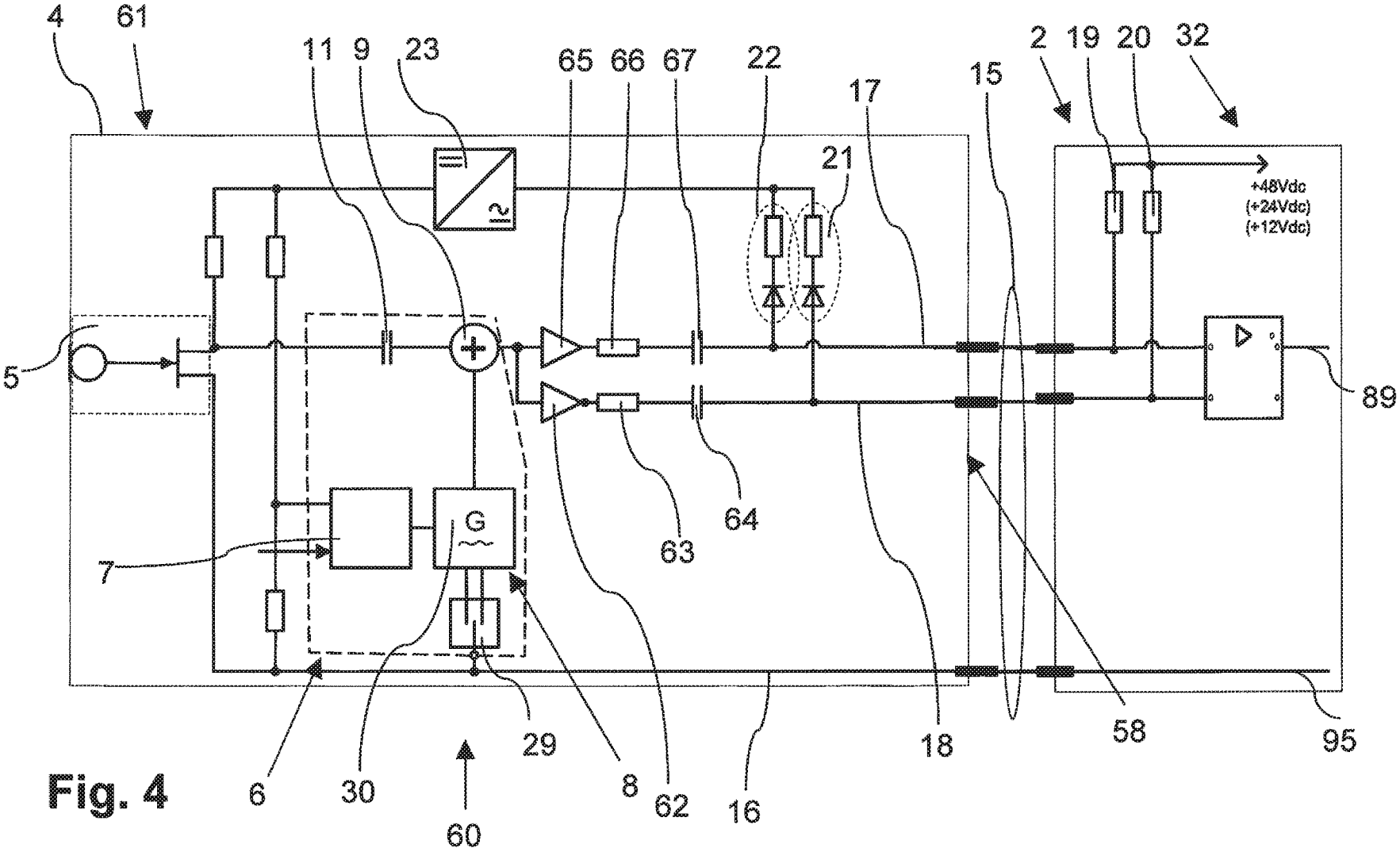
FIG. 4 shows an arrangement of power supply and a fourth variant of a microphone.

FIG. 4 depicts an arrangement 60 of the power supply 2 according to FIG. 1 and a fourth variant of a microphone 61. The microphone 61 comprises the test signal generator unit 8 according to FIG. 1.

The microphone 61 therefore differs only in that the microphone 61 has a second non-inverting output driver 65 in addition to a first inverting output driver 62. An impedance network 63, 64 connects to the inverting output driver 62 and an impedance network 66, 67 connects to the non-inverting output driver 65. Because of these two output drivers 65, 62, the microphone 61 has a symmetrical microphone output 58. Hence, the signal coming from the adder 9 is simultaneously supplied to the non-inverting output driver 65 and the inverting output driver 62. These output drivers 62, 65 each have a gain of 0.5. From the non-inverting output driver 65, the non-inverting output signal reaches the microphone output 58 via the output impedance 66, 67. Accordingly, the inverting output signal from the output driver 62 reaches the microphone output 58 via the output impedance 63, 64. If both output signals are evaluated by a corresponding system component, for example a computer sound interface with a differential input (not shown), the two individual microphone signals add up to 1.

The test signal and the reference test signal therefore appear at the microphone output 58 only with a single amplitude and not with a double amplitude.

Figure 5:
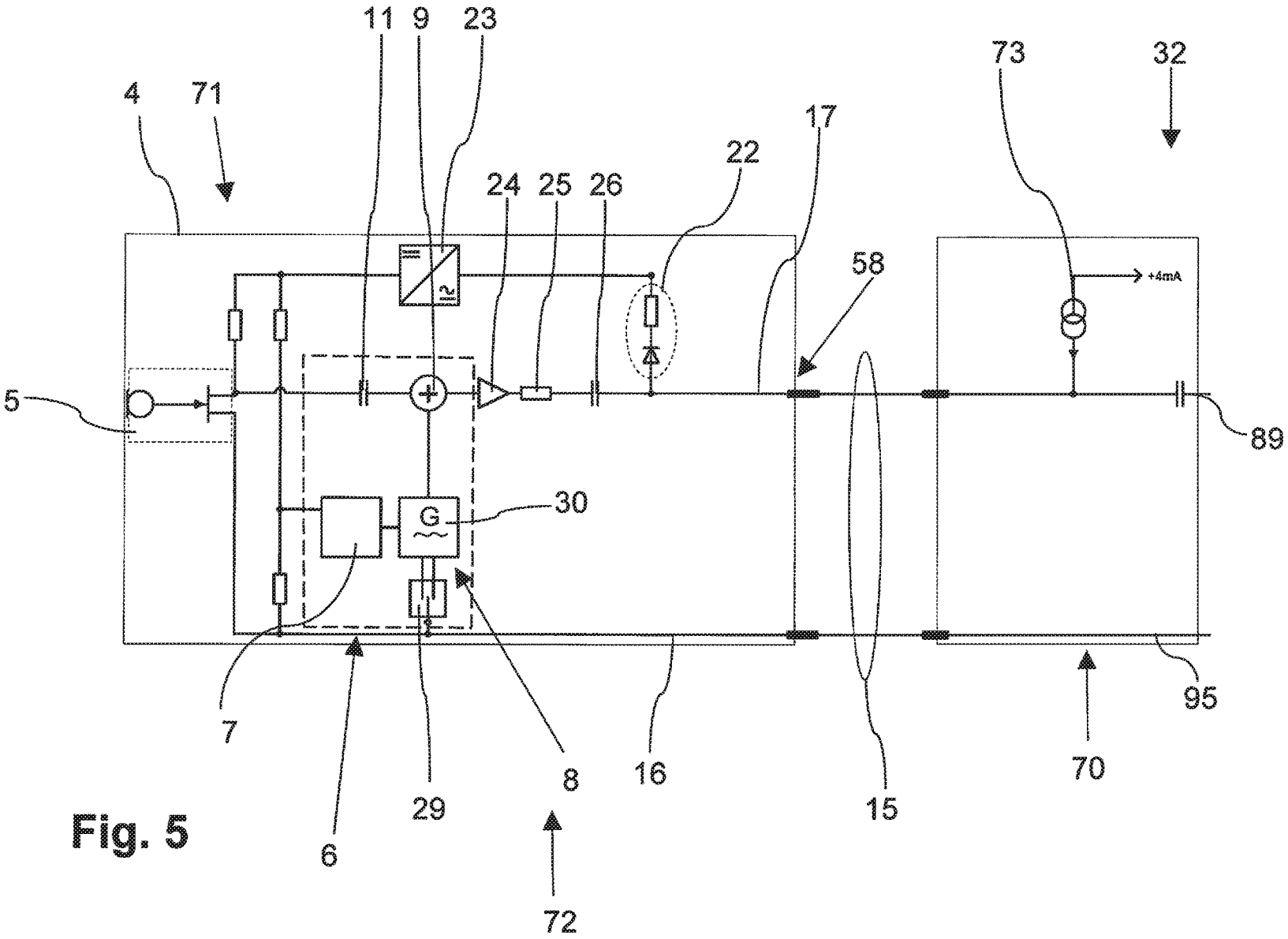
FIG. 5 shows an arrangement of power supply and a fifth variant of a microphone.

FIG. 5 depicts a further exemplary embodiment of the invention, a variant of a power supply unit 70 and a fifth variant of a microphone 71 forming an arrangement 72. However, in this exemplary embodiment there is no phantom power, but constant current power instead. For this purpose, the power supply unit 70 has a constant current source 73.

Therefore, the connection of the microphone 71 and the energy supply take place via only one electrical line, namely the line 17.

Signal processing and power supply in the microphone 71 are almost identical to the variant according to FIG. 1, which is why the reference numbers of the individual components of the microphone 71 have been retained.

Figure 6:
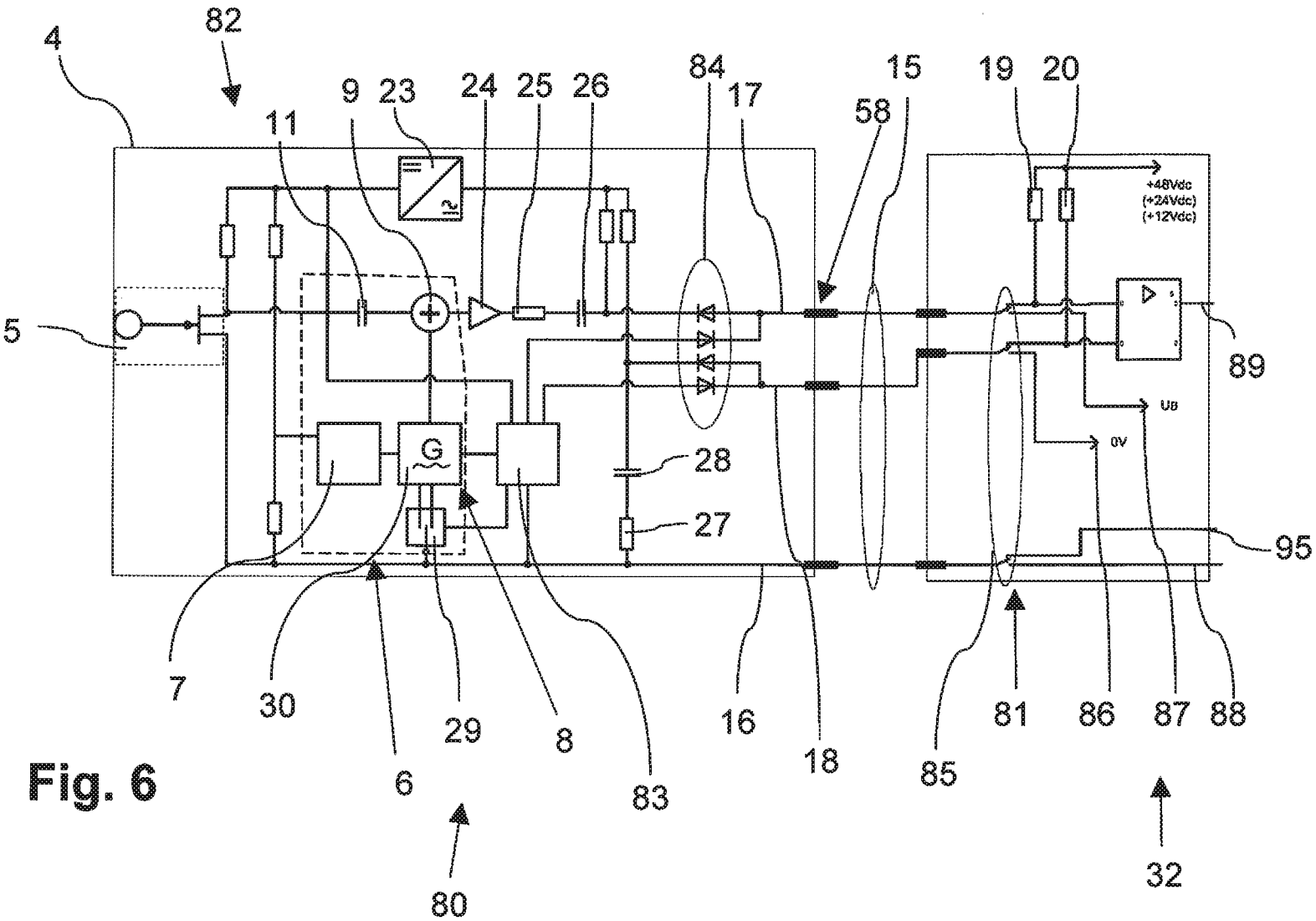
FIG. 6 shows an arrangement of power supply and a sixth variant of a microphone.

FIG. 6 depicts a further arrangement 80 comprising a variant of a power supply unit 81 and a sixth variant of a microphone 82. The microphone 82 comprises the test signal generator unit 8 according to FIG. 1. The microphone 82 is equipped with an integrated data chip (EEPROM) within a maintenance and data unit 83, which can be easily read out via the existing microphone lines 16, 17, 18 or the connecting line system 15, wherein these microphone lines also allow remote control and maintenance of the microphone 82.

Maintenance and programming signals for maintenance of the microphone 82 are fed to the maintenance and data unit 83 via the identical microphone lines 16, 17, 18. For this purpose, the maintenance and programming signals generated by an external computer are available to the maintenance and data unit 83 after a signal decoding in a diode network 84. These maintenance and programming signals are expanded in the power supply unit 81 by means of a signal assignment via a relay switch 85.

A phantom power is supplied via supply resistors 19, 20, which is switched off in the case of remote maintenance, a supply voltage 86, 87 and a data line 88 then being connected.

In addition to the data line 88, a signal line 89 and a ground line 95 can also be seen. By switching, the ground line 95 becomes the data line 88.

Figure 7:
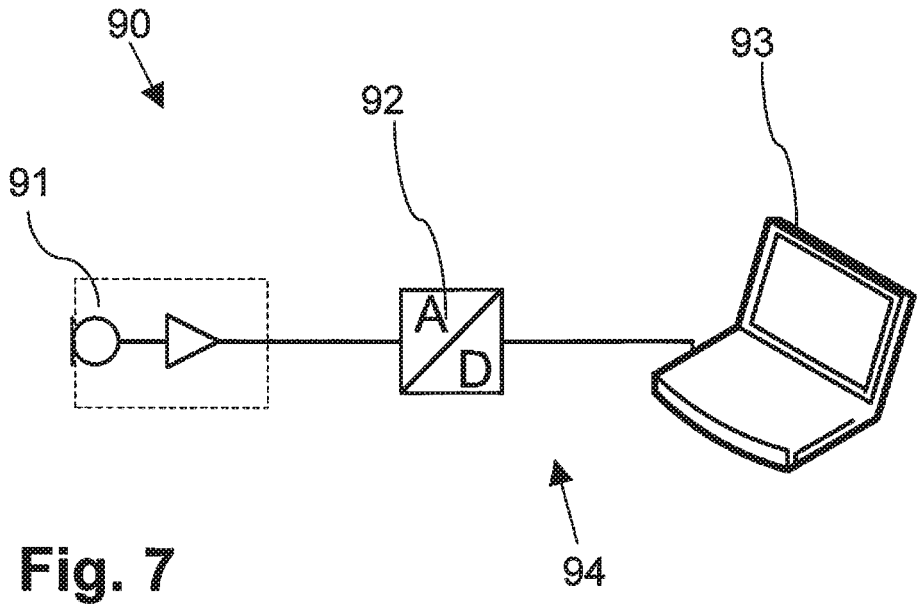
FIG. 7 shows a device consisting of a microphone, analog-digital converter and computer.

FIG. 7 depicts a device 90 comprising a microphone 91, an analog-digital converter 92 and a computer 93, the analog-digital converter 92 and the computer 93 being part of an arrangement 94 of external system components. The computer 93 or a software-integrated handheld device (not shown) is used to evaluate and diagnose the microphone function and other downstream signal components, such as the analog/digital converter 92.

Figure 8:
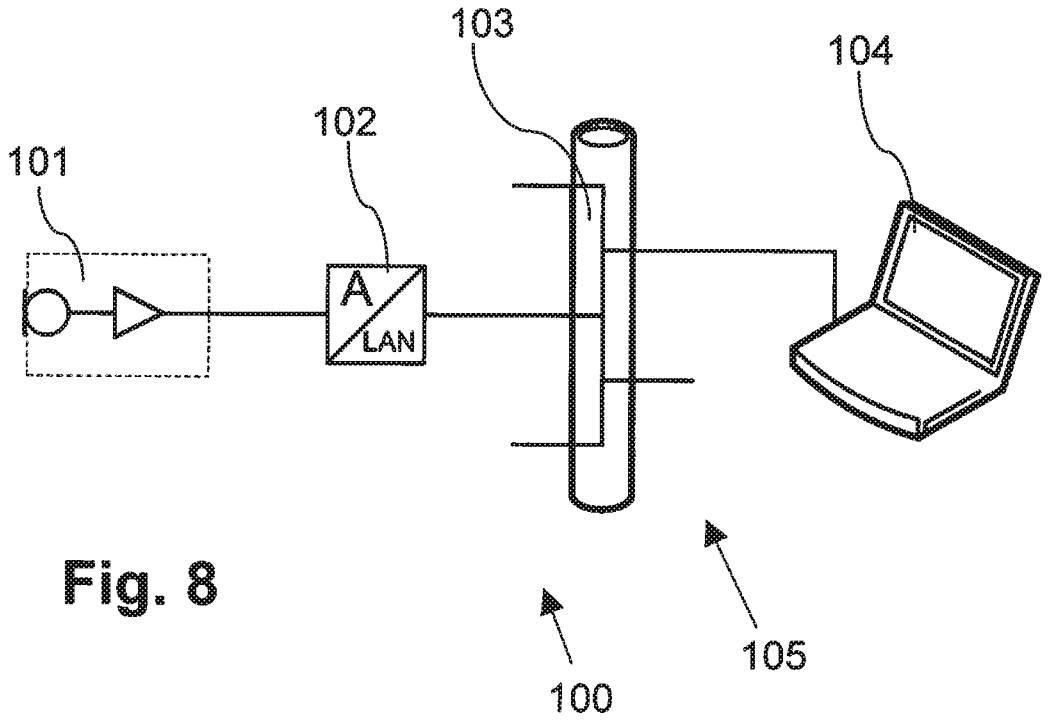
FIG. 8 shows a first variant of the device according to FIG. 7.

FIG. 8 depicts a first variant of the device according to FIG. 7. This device 100 comprises a microphone 101, an audio network converter 102, an ethernet network 103 and a computer 104. Audio network converter 102 and ethernet network 103 are part of an arrangement 105 of external system components 102, 103.

Figure 9:
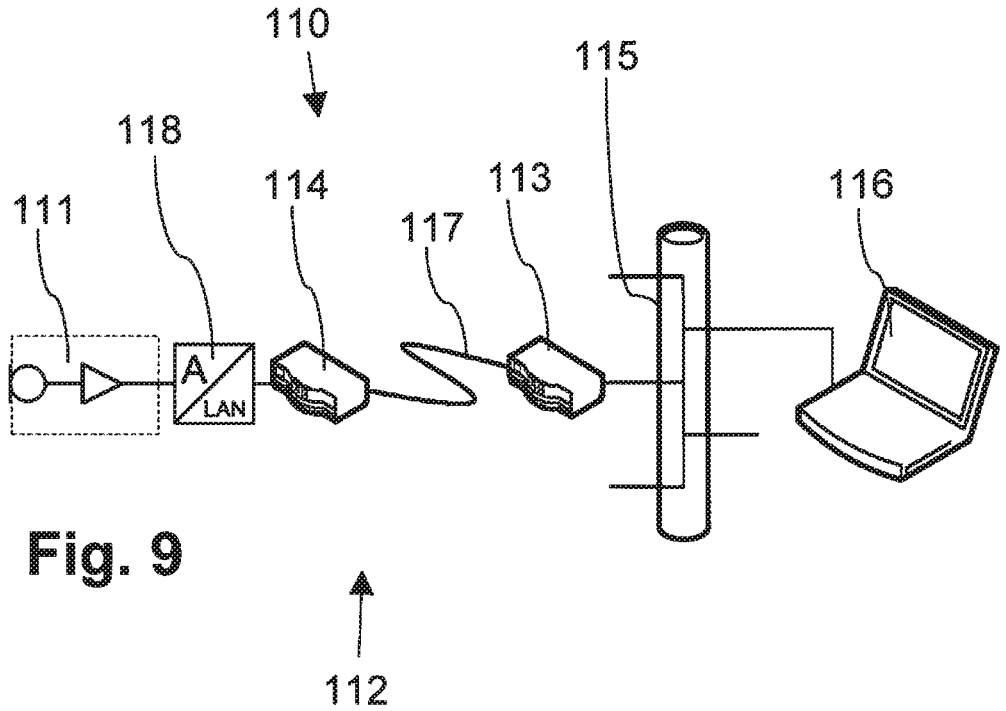
FIG. 9 shows a second variant of the device shown in FIG. 7.

FIG. 9 depicts a second variant of the device pursuant to FIG. 7. The device 110 comprises a microphone 111 and an arrangement 112 of external system components, namely an audio network converter 118, two fiber optic converters 113, 114, which are connected to one another via a fiber optic cable 117, and an ethernet network 115.

The evaluation and diagnosis of the function of the microphone 111 and the downstream system components 112 to 115, 117 is carried out with a computer 116.

Figure 10:
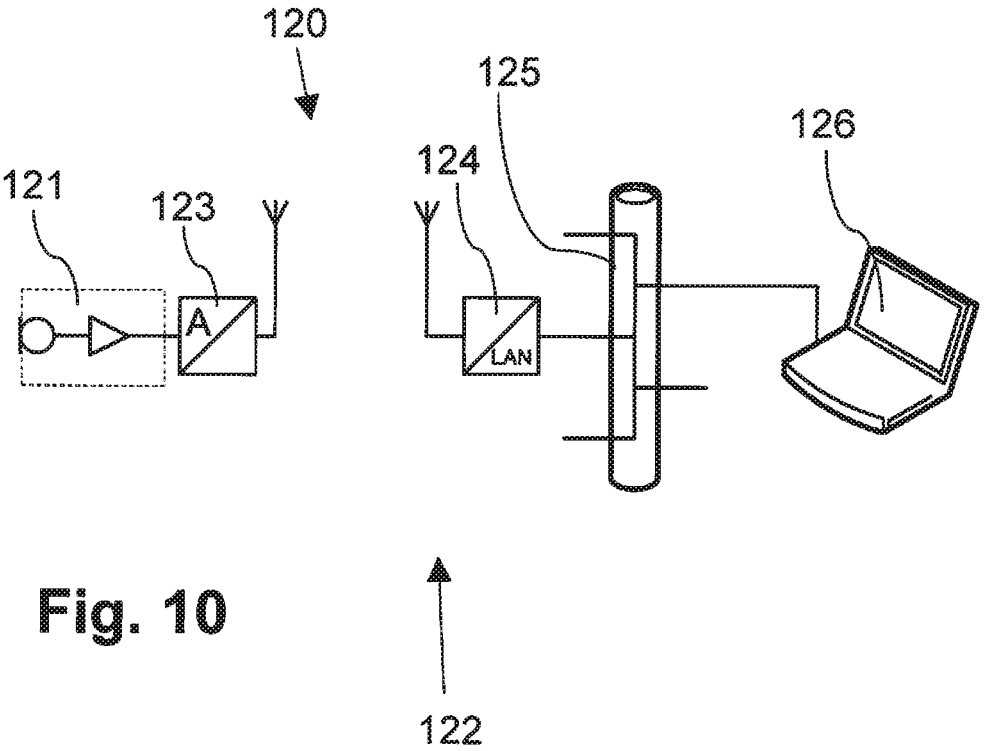
FIG. 10 shows a third variant of the device shown in FIG. 7.

FIG. 10 depicts a third variant 120 of the device shown in FIG. 7. The device 120 comprising a microphone 121, an arrangement 122 of external system components 123 to 125 and a computer 126.

The external system components 123 to 125 are a radio transmitter 123 and a radio receiver 124, which are in contact with one another via radio. System component 125 is an ethernet network.

Figure 11:
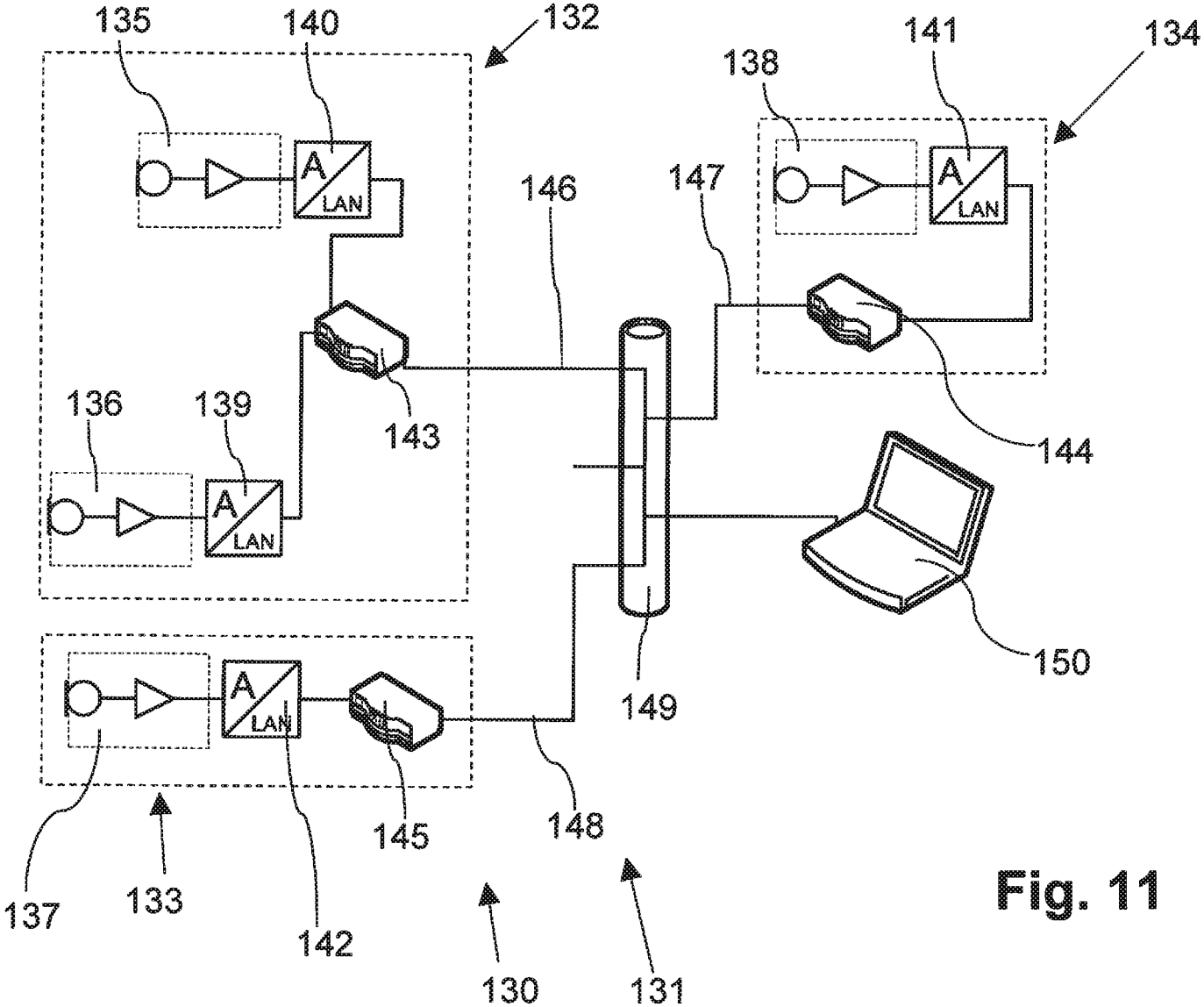
FIG. 11 shows another variant of the device shown in FIG. 7.

In FIG. 11 depicts another variant 130 of the device shown in FIG. 7. This device 130 can be provided, for example, at a major event 131 with different event locations 132, 133, 134. At each event location 132, 133, 134, at least one microphone 135 to 138, in particular a measurement microphone for sound level monitoring, is provided.

Each microphone 135 to 138 is connected to an audio network converter 139 to 142, each of these audio network converters 139 to 142 being connected to an ethernet router 143 to 145. The ethernet routers 143 to 145 are connected to an ethernet network 149 via ethernet cables 146 to 148. The evaluation and diagnosis of the microphones 135 to 138 and the other downstream system components 139 to 142 and 143 to 145 takes place via a computer 150, which is also connected to the ethernet network 149.

Figure 12:
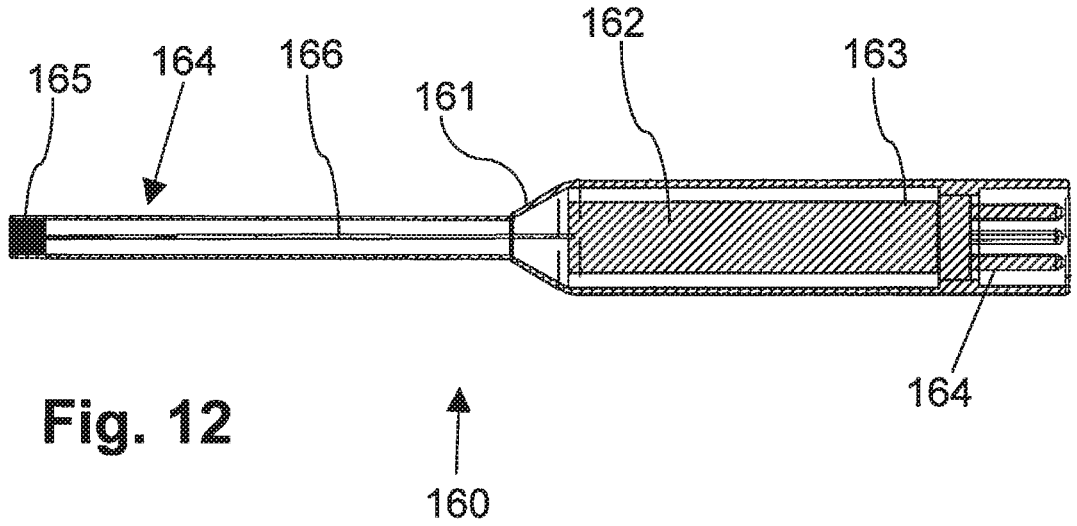
FIG. 12 shows a schematic representation of a microphone.

FIG. 12 shows a schematic representation of a microphone 160, in particular a measuring microphone for sound level monitoring. In a housing 161 of the microphone 160 there is a printed circuit board 162 on which all components for microphone and system diagnosis are being arranged. In a rear section 163 of the microphone 160, a connector 164 is provided, to which a cable can be connected, which is not shown in FIG. 12, however.

In a front section 164 there is a microphone capsule 165, which is electrically connected to the circuit board 162 via a cable 166.

Figure 13:
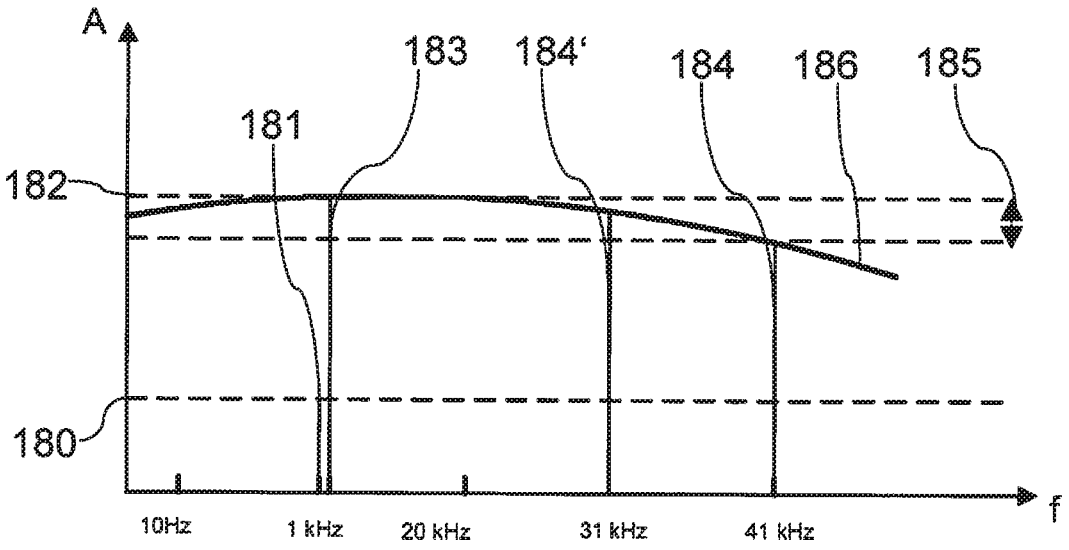
FIG. 13 shows a graphical representation of an amplitude curve at different frequencies and test signal for different operating states.

The process for sound level monitoring comprises the following successive process steps (cf. FIG. 13, in which an amplitude curve is shown graphically at different frequencies):

1. Exposing the microphone to an external acoustic sound pressure level 181 at a microphone sensitivity of 94 dB (reference number 180) at a defined frequency, for example 1 kHz, or applying the microphone to a sound pressure level 181 of 114 dB (reference number 180) at a defined frequency, for example 1 kHz, and then measuring the amplitude of the microphone output signal.
2. Switch off or remove the acoustic test sound level and switch on the reference test signal 183 (=actual reference test alternating voltage 183) at the maximum sound pressure level 182 to be recorded (=upper limit of the test alternating voltage), for example 140 dB (reference number 182).
3. Measurement of the amplitude of the reference test signal and check for plausibility of the measured amplitudes, the microphone sensitivity+xdB corresponding to the maximum sound pressure level 181, in this case 94 dB+46 dB=140 dB. If the level of the reference test signal being measured by software is less than 140 dB, the system, which comprises one or more system components, cannot process the sound pressure level correctly. This means that one or more of the system components used are not suitable and may have to be replaced.
4. Activation of the permanent test signal 184 (microphone according to FIG. 2) or switching from reference test signal 183 (=actual reference test alternating voltage 183) to a permanent test signal 184 (microphones according to FIGS. 1, 3, 4, 5 and 6).
5. Comparison of the amplitude A of the reference test signal 183 with the amplitude of the permanent test signal 184; either directly when using two generators (reference numbers 42, 44; cf. FIG. 2) or after switching switch 29 (compare FIG. 1), whereby a level difference 185 is obtained, which corresponds to an amplitude correction factor 185.
6. Monitoring the permanent test signal 184 with respect to the amplitude A and the frequency of each microphone.

In the present example (cf. FIG. 13) the microphone 1 delivers a permanent test signal with a frequency of 41 kHz and is therefore sufficiently supplied with energy since the supply voltage is sufficiently high. If the test signal frequency were 31 kHz, the microphone 1 would not have a sufficient supply voltage. This too low supply voltage is detected as undervoltage within the microphone and the permanent test signal frequency is switched from 41 kHz (reference number 184) to 31 kHz (reference number 184').

It is advantageous that different microphones can be distinguished on the basis of a frequency coding of the test signal within the test signal generator unit, so that several microphones (cf. FIG. 11; microphones 135 to 138) can work with different test signal frequencies within a network.

A different test signal frequency (=frequency offset) is used for each microphone 135 to 138, as a result of which each microphone can be identified on the basis of this test signal frequency (for example microphone 135—41 kHz, microphone 136—42 kHz, microphone 137—43 kHz, microphone 138—44 kHz).

Through the combination of frequency offset and amplitude measurement, the operating states of each microphone as well as the operating states of the signal chain can be detected and any manipulations, such as changing the gain of system components (microphone amplifiers), in particular reducing the gain and thus reducing the microphone signal amplitude, which means a reduction corresponds to the measured sound pressure level, or, for example, the insertion of signal attenuators can also be analysed and verified.

Although only a few embodiments of the present invention have been shown and described, it is to be understood that many changes and modifications may be made thereunto without departing from the spirit and scope of the invention.

REFERENCE LIST

1 Arrangement
2 Power adapter
3 First variant of a microphone
4 Casing
5 Microphone capsule
6 Test arrangement
7 Undervoltage detector
8 Test signal generator unit
9 Adder
10 First electrical line
11 Coupling capacitor
12, 12', 12" Second electrical line
13, 14 Electric lines
15 Connection line system
16 Ground line
17 First signal line
18 Second signal line
19, 20 Resistors
21, 22 Diode resistance network
23 Voltage stabilization device
24 Output driver
25, 26 First impedance network
27, 28 Second impedance network
29 Electronic switch
30 Test signal generator
31 Undervoltage detector input
32 Arrangement
33 Supply voltage line
34 - - -
35 - - -

36 - - -
37 - - -
38 - - -
39 - - -
40 Second variant of a microphone
41 Test arrangement
42 Sine reference test signal generator
43 Counter
44 Permanent test signal generator
45 Input of the undervoltage detector
46 Arrangement
47 - - -
48 - - -
49 - - -
50 Third variant of a microphone
51 Arrangement
52 Test arrangement
53 Test signal generator
54 Electronic switch
55 Control line
56 Electronic switch
57 Noise generator
58 Microphone output
59 Remote control input
60 Arrangement
61 Fourth variant of a microphone
62 First inverted output driver
63, 64 Impedance network
65 Second non-inverted output driver
66, 67 Impedance network
68 - - -
69 - - -
70 Power supply variant
71 Fifth variant of a microphone
72 Arrangement
73 Constant current source
74 - - -
75 - - -
76 - - -
77 - - -
78 - - -
79 - - -
80 Arrangement
81 Power adapter
82 Sixth variant of a microphone
83 Maintenance and data unit
84 Diode network
85 Relay switch
86, 87 Supply voltage
88 Data line
89 Signal line
90 Device
91 Microphone
92 Analog-to-digital converter
93 Computer
94 Arrangement of external system components
95 Ground line
96 - - -
97 - - -
98 - - -
99 - - -
100 Device
101 Microphone
102 Audio network converter
103 Ethernet network
104 Computer
105 Arrangement of external system components
106 - - -
107 - - -
108 - - -
109 - - -
110 Second variant of the device according to FIG. 8
111 Microphone
112 Arrangement
113, 114 Fiber optic converter
115 Ethernet network
116 Computer
117 Fiber optic cable
118 Audio network converter
119 - - -
120 Third variant of the device shown in FIG. 8
121 Microphone
122 Arrangement of external system components
123 Radio transmitter
124 Radio receiver
125 Ethernet network
126 Computer
127 - - -
128 - - -
129 - - -
130 Fourth variant of the device according to FIG. 8
131 Major event
132 to 134 Event locations
135 to 138 Microphones
139 to 142 Audio network converter
143 to 145 Ethernet router
146 to 148 Ethernet cable
149 Ethernet network
150 Computer
151 - - -
152 - - -
153 - - -
154 - - -
155 - - -
156 - - -
157 - - -
158 - - -
159 - - -
160 Schematic representation of a microphone
161 Microphone housing
162 Circuit board
163 Rear section of the microphone
164 Connectors
165 Microphone capsule
166 Electric wire
167 to 179 - - -
180 Lower sound pressure level (94 dB or 114 dB)
181 External acoustic reference sound pressure level
182 Upper limit of the AC test voltage (140 dB)
183 Actual reference test AC voltage
184, 184' Permanent AC test voltage
185 Level difference
186 Amplitude frequency response

What is claimed is:

1. A microphone having a microphone capsule, wherein the microphone comprises a test arrangement, the test arrangement comprising:

an undervoltage detector;

a test signal generator unit; and an adder;

wherein the microphone capsule is connected to the adder via a first electrical line, a supply voltage line being connected to the undervoltage detector via a second electrical line;

wherein in the undervoltage detector the operating DC voltage of the microphone is comparable with an internal reference DC voltage, the undervoltage detector is electrically connected to the test signal generator unit; and wherein the test signal generator unit is electrically connected to the adder.

2. The microphone according to claim 1, wherein the test signal generator unit comprises a signal generator, the signal generator being electrically connected to an electronic switch, wherein a reference test signal generated from the signal generator is switchable to a permanent test signal via the electronic switch.

3. The microphone according to claim 1, wherein the test signal generator unit comprises a test signal generator and a sine reference test signal generator, the sine reference test signal generator being switchable via a switch.

4. The microphone according to claim 2, wherein the test signal generator unit additionally comprises a noise generator for measuring and assessing the amplitude frequency response of external system components, the noise generator being manually switchable or remotely switchable via an electronic switch.

5. The microphone according to claim 1, wherein the microphone comprises a first inverting output driver and a second non-inverting output driver, whereby the microphone has a symmetrical microphone output.

6. An arrangement comprising the microphone according to claim 1 and an arrangement formed by external system components, wherein the microphone is connected to the external system components via a connecting line system.

7. The arrangement according to claim 6, further comprising a computer arranged to the external system components which carries out the evaluation and diagnosis of the function of the microphone and the external system components.

8. A method for sound level monitoring of a microphone with a test arrangement according to claim 1, comprising the following successive method steps:

1. providing an external acoustic sound pressure level;
2. exposing the microphone to at the external acoustic sound pressure level which is equal to a microphone sensitivity of 94 dB at a defined frequency or exposing the microphone to the external acoustic sound pressure level of 114 dB at a defined frequency and subsequent measurement of the amplitude of a microphone output signal;
3. switching off or removing an acoustic test sound level and switching on a reference test signal at the level of a maximum sound pressure level;
4. measuring the amplitude of the reference test signal and checking for plausibility of the measured amplitudes;
5. hooking-up of a permanent test signal or switching the reference test signal to a permanent test signal;
6. comparing the amplitude of the reference test signal with the amplitude of the permanent test signal, whereby a level difference is obtained; and
7. monitoring the permanent test signal with respect to the amplitude and frequency of each microphone.

* * * * *